US005458164A

United States Patent [19]

Tawil

[11] Patent Number: 5,458,164

[45] Date of Patent: Oct. 17, 1995

[54] LUGGAGE STUFFER

[75] Inventor: Joseph D. Tawil, Brooklyn, N.Y.

[73] Assignee: La Rue International Inc., New York, N.Y.

[21] Appl. No.: 111,168

[22] Filed: Aug. 24, 1993

[51] Int. Cl.[6] ..... A45C 13/02

[52] U.S. Cl. ..... 141/10; 141/67; 141/114; 141/330; 383/3; 383/33; 383/127; 206/522; 222/5; 222/83.5

[58] Field of Search ..... 141/10, 67, 114, 141/329, 330, 19; 383/3, 33, 127; 150/900; 190/106; 206/522; 222/5, 83, 83.5; 441/30, 40, 41, 93, 94

[56] References Cited

U.S. PATENT DOCUMENTS

| | | | |
|---|---|---|---|
| 1,759,336 | 5/1930 | Wollk | 141/330 X |
| 2,722,342 | 11/1955 | Fox | 222/5 |
| 2,970,326 | 2/1961 | Keefe | 441/93 |
| 3,061,148 | 10/1962 | Knapp | 141/19 X |
| 3,090,979 | 5/1963 | Segrest | 441/94 |
| 3,132,626 | 5/1964 | Reid | 441/30 |
| 4,142,564 | 3/1979 | Zoland | 383/127 |

FOREIGN PATENT DOCUMENTS

| | | | |
|---|---|---|---|
| 2417448 | 10/1979 | France | 206/522 |
| 2157552 | 10/1985 | United Kingdom | 383/3 |

*Primary Examiner*—J. Casimer Jacyna
*Attorney, Agent, or Firm*—Steven H. Bazerman

[57] ABSTRACT

A luggage stuffer for soft-wall luggage comprises an air-tight bladder containing a gas supply mechanism which is activatable to inflate the bladder to fill a storage volume of the luggage. In this way, the luggage is inflated for display.

13 Claims, 4 Drawing Sheets

LUGGAGE STUFFER

FIELD AND BACKGROUND OF THE INVENTION

The present invention relates in general to the stuffing of luggage such as soft-walled luggage and the like, for display purposes, and in particular, to a new and useful apparatus and method of stuffing luggage for display.

For mass storage and transport, soft-sided luggage such as suitcases, duffle bags, back-packs, toiletry bags, cosmetic cases, tote bags and the like, are collapsed and stocked in as compact a manner as possible. While this configuration is appropriate for minimizing space during storage and transport, it is not appropriate for display. The bag must appear to be full to show its design in a retail store or other points of sale.

It has long been conventional to stuff such soft-sided luggage with paper, or to provide semi-rigid inserts such as cardboard cylinders, boxes and the like, to expand the soft-side luggage to its full position for display.

U.S. Pat. No. 4,434,894 (Lee), for example, discloses how a plurality of cloth bags can be shipped in a collapsed position with cardboard packing sheets that are initially used to separate layers of luggage, later used in a curled cylindrical position, as stuffing inserts for the bags. U.S. Pat. No. 4,077,451 (Zoland) describes an expandable bag. The actuator is a draw string which releases two cards having a spring. U.S. Pat. No. 5,179,600 (Bailey et al.) describes an expandable insert for soft luggage. An elastic band engages two web members to expand it.

A more elaborate expansion mechanism for soft bags is disclosed in U.S. Pat. No. 4,993,846 (Diamond, et al.). It is also known, for example, from French Patent 2,417,448, published Sep. 14, 1979, to provide an air-tight flexible bladder inside a soft-walled brief case to inflate the brief case for display. The bladder has a filling spout which is filled with air from an exterior source of air such as a pump or the like. It is also known to use a flexible air-tight bladder inside a soft-walled bag or luggage, to convert the bag or luggage into a pillow. See for example, U.S. Pat. Nos. 1,927,471 (Salomon) and 1,864,648 (Haines). Here again, inflation is achieved using exterior sources of air.

It is also known to inflate the side-walls of flexible luggage to provide cushioning. See for example, U.S. Pat. No. 3,587,794 (Mattel). These references do not advocate completely filling the interior space of a luggage since the purpose is to maintain storage space and not to fill the luggage for display purposes. U.S. Pat. No. 4,573,202 (Lee) discloses a container having inflatable side-walls to protect the contents of the bag with an incorporated manually operated pump for inflating the side-walls.

Whether to inflate the bag for display, as a pillow or to protect goods in the interior of the bag, exterior sources of air have always been utilized to inflate either the luggage filling bladder or the side-walls of the luggage.

It would be impractical to manually inflate soft-sided luggage for display purposes at the point of sale since normally a large number of pieces are displayed at the point of sale. The exertion and time needed for inflating the luggage for display purposes would be impractical. Equally, it would be impractical to maintain inflating apparatus such as air pumps on or around the selling floor.

In fields outside the field of luggage stuffing for display purposes, self-inflating apparatuses are known. An inflatable enclosure using the chemical generation of gas to inflate balloons, flotation equipment or the like, is known from U.S. Pat. No. 4,929,214 (Liebermann). A pair of sealed envelopes are provided in a pouch. Each envelope contains a different reactive component, which when mixed together, generates gas. External pressure ruptures the envelopes instituting the reaction and inflating the enclosure. An inflatable life-belt including $CO_2$ cartridges is disclosed in U.S. Pat. No. 5,114,041 (DiForte). Actuators are provided for piercing the standard $CO_2$ cartridge that inflates the belt.

Other examples of references disclosing self-inflating apparatus are as follows: U.S. Pat. No. 1,772,674 (Markus) describes an inflating device for safety belts and the like. The actuating means is a button & clasp combination that actuates a compressed air cartridge to inflate the belt. U.S. Pat. No. 2,675,114 (Elikann) describes a life preserver inflating device. U.S. Pat. No. 2,970,326 (Keefe) describes an emergency life saving device. The device has an operating card that pierces a gas container to inflate the device. U.S. Pat. No. 3,014,619 (Moran) describes an inflator for inflatable bodies. The inflator handle is a bell crank lever. U.S. Pat. No. 3,227,309 (Segrest) describes an inflating device. The device includes a pull-cord that actuates a piercing mechanism. U.S. Pat. No. 3,329,982 (Zannoni) describes a life preserver. The actuating means includes a pair of lanyards. U.S. Pat. No. 3,536,232 (Lightcap) describes a target inflation device. The actuating means includes a pin that is unscrewed and removed. U.S. Pat. No. 3,547,165 (Butterworth) describes a gas inflation mechanism. The actuating means includes a pull cord. U.S. Pat. No. 3,704,032 (Fiala) describes an actuating means for inflating crash pads. U.S. Pat. No. 3,833,029 (Munn) describes a method and apparatus for generating gaseous mixtures for inflatable devices wherein the actuating means is a cable or lanyard. U.S. Pat. No. 4,223,805 (Mackal) describes an automatic inflator. U.S. Pat. No. 4,416,393 (Zimmerly) describes an inflator guard. U.S. Pat. No. 5,062,546 (Mackal) describes a snap rivet safety lock for inflators. The actuating means is a lanyard. U.S. Pat. No. 5,099,716 (Mackal) describes a lanyard that actuates an inflator.

The prior art as a whole would not render obvious a mechanism for automatically inflating luggage for display, which is sufficiently economical and reliable to be used for that purpose, without the danger of premature expansion during storage or transit, but with a self-contained gas supply to permit inflation in the simplest, fastest and most economical manner at the point of sale.

SUMMARY OF THE INVENTION

Accordingly, an object of the present invention is to provide a luggage stuffer for filling soft-walled luggage having a storage volume therein, for display, comprising: an air-tight bladder having a deflated condition which is collapsed for positioning in soft-walled luggage which is also collapsed for storage and transport, said bladder having an inflated condition substantially corresponding to the storage volume of the luggage for filling the luggage for display of the luggage at a point of sale for the luggage; self-contained, attached gas supply means connected to the bladder for inflating the bladder from the deflated condition to the inflated condition; and actuation means operatively connected to the gas supply means for activating the gas supply means to inflate the bladder to its inflated condition.

A further object of my invention is to provide such a luggage stuffer which has a means for initiating the inflation of the bladder from the exterior of the luggage to be stuffed with the luggage essentially closed, thereby insuring that the bladder is held in the luggage during inflation.

A further object of the present invention is to provide a luggage stuffer which is simple in design, rugged in construction and economical to manufacture, and which can be activated on a sales floor or at a point of sale, immediately before the luggage is displayed for sale. Such a system would reduce both labor and freight costs and have a reduced impact on the environment.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 3:
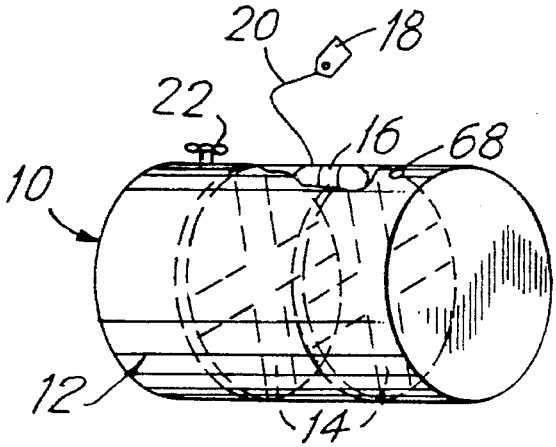
FIG. 3 is a perspective view of a bladder in its inflated condition, for use in the luggage of FIG. 1 and 2.

Referring to the drawings in particular, the invention embodied therein comprises a luggage stuffer generally designated 10 in FIG. 3 which comprises an air-tight bladder 12 made, for example, of resilient plastic and having a shape corresponding to the luggage in which it is to be positioned.

The shape is maintained even though the bladder is inflated, by one or more internal baffles 14 which span the inner cross-section of bladder 12 but are open for the passage of air so that a single continuous air compartment exists within the bladder.

According to the present invention, an air supply mechanism 16 is connected to the bladder, in the embodiment shown, sealed within the bladder before the bladder is closed by subsequent manufacturing steps.

A pull-tab 18 connected to a cord 20 forms actuator means for the gas supply mechanism 16. After the bladder is filled in accordance with the present invention, if for some reason the expanded shape of the bladder is lost, it can be refilled through an auxiliary nozzle 22 having a closure cap which is normally closed. Excess gas pressure is relieved through a one-way vent valve 68.

Figure 1:
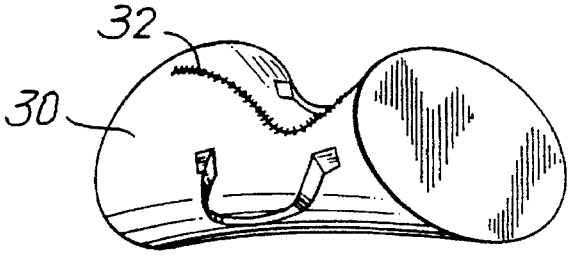
FIG. 1 is a side-elevational view of a partly collapsed soft-walled luggage, in this case a duffle bag, after it is partially opened from a totally collapsed storage condition.

FIG. 1 shows a partly collapsed soft-walled duffle bag 30 forming a soft-walled luggage of the present invention. Although a duffle bag shape is shown, the present invention is equally applicable to back-packs, tote bags, suitcases, and any other luggage, storage bags or compartments of the soft-walled variety.

For storage, soft-walled luggage is normally collapsed to the flattest and smallest possible volume and then shipped with many other like luggage to a place of storage.

Figure 2:
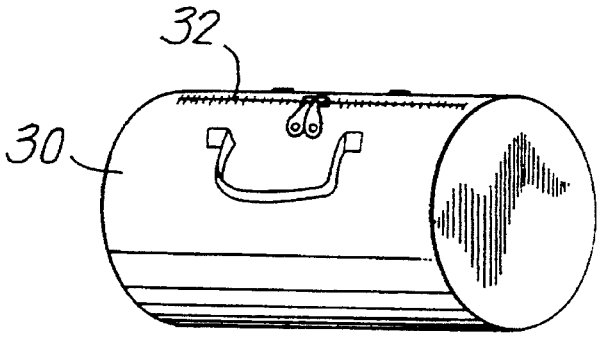
FIG. 2 is a view similar to FIG. 1 of the soft-walled luggage fully stuffed according to the present invention and in a condition for display at a point of sale.

Only when the luggage is being prepared for sale at a point of sale, is it deployed to its fully opened position shown in FIG. 2, preferably taking its proper shape when neatly packed with a full load of material within its storage volume.

According to the prior art, cardboard, crumpled paper or any other disposable stuffing material was used to achieve the shape of FIG. 2. Depending on the softness of the walls, the perfect shape was either attained or not.

In accordance with the present invention, bladder 12 in its fully deflated and collapsed condition is provided within each soft-walled luggage 30. Just before the luggage is to be put in its display condition (FIG. 2) for display at a point of sale, a zipper or other opening 32 is only partly opened to gain access to tab 18 and cord 20 of the gas supply means. The tab and cord are pulled briskly which activate the gas supply means 16 that fully inflates the bladder 12 to its final shape and volume, which advantageously conforms to the shape and volume of the main storage compartment in the soft-walled luggage. This allows the luggage to be stuffed with the luggage essentially closed, thereby ensuring that the bladder is held in position in the luggage during inflation.

If the soft-walled luggage is a rectangular briefcase, an appropriately shaped bladder 12 with baffles 14 is provided. Any other shape can be accommodated by the proper bladder and baffle configuration.

Figure 4:
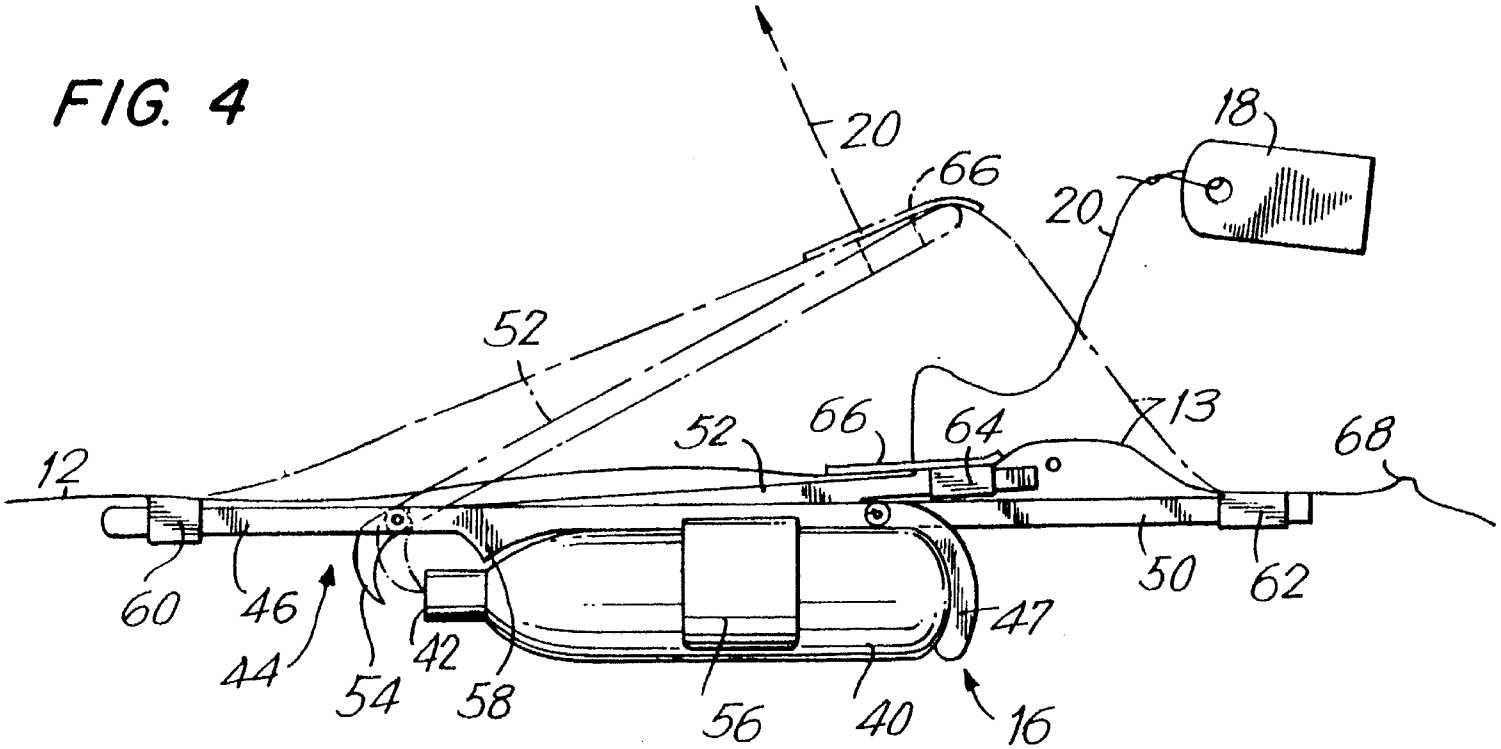
FIG. 4 is a side-elevational view of a gas supply mechanism with actuator for use in conjunction with the bladder.

As best shown in FIG. 4, gas supply means 16 comprises a conventional $CO_2$ cartridge 40 having a piercable end 42 which can be pierced by a sharp object in a conventional manner. Depending on the storage volume in the luggage to be stuffed, larger or smaller $CO_2$ cartridges 40 are utilized.

Since the luggage stuffer 10 of the present invention is meant for use during display only, the bladder and mechanism must be as inexpensive as possible, but at the same time, not deploy unexpectedly, for example, during transport or storage.

Figure 5:
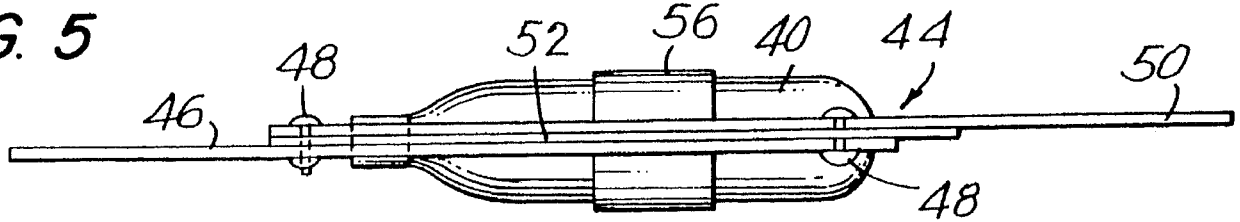
FIG. 5 is a top plan view of the mechanism shown in FIG. 4.

To this end, the gas supply means comprises a cradle 44 which uses no spring-loaded trigger or other such mechanism that may be activated unintentionally. Cradle 44 has one substantially J-shaped member 46 which is connected by a pair of rivets or connecting pins 48 to a second substantially straight member 50. A piercing lever 52 is pivotly mounted between members 46 and 50 by the left hand rivet 48 of FIGS. 4 and 5, which acts as a pivot journal. Lever 52 has a curved actuation end 54 which ends in a sharp point, curved toward the piercable end 42 of cartridge 40. A C-shaped clip 56 is permanently attached to the members 46 and 50 and is curved downwardly to firmly clasp the body of cartridge 40. Projections 58 extend downwardly from each of the members 46 and 50 to retain the cartridge 40 against the curved base 47 of the J-shaped member 46. In this way, cartridge 40 is held firmly from movement in any direction with respect to the cradle 44. This is important since care must be taken against inadvertently puncturing the piercable end 42 during vibrations, shifts, or other unexpected movements, while the stuffing mechanism is being transported.

Cradle 44 is firmly held to the inner surface of bladder 12, by a first strap 60 which is elastic and engages around the forward end of J-shaped member 46 and a second strap 62 engaged around the elongated rear end of straight member 50. In the vicinity over piercing lever 52, bladder 12 is provided with a wrinkled or loose area 13. Lever 52 is held to the inner surface of loose area 13 by a further strap 64. A reinforcing patch 66 is fixed, for example, by gluing or welding, over strap 64. Actuating cord 20 is fixed to patch 66 and pull-tab 18 is fixed to the end of cord 20. Members 46 and 50, clip 56 and lever 52 are made of metal.

To activate gas supply means 60 in a very simple manner, cord 20 is briskly pulled in the direction of the arrow. This lifts the patch 66 and the loose area 13 to which it is connected upwardly and away from the rest of bladder 12. To improve efficiency, it may be useful to hold the bladder 12 down at the areas of straps 60 and 62. This will pivot lever 52 to its phantom line position, causing the sharp end 54 to of the level to pierce piercable end 42. With cord 20 released, a free stream of compressed $CO_2$ gas leaves cartridge 40 and fills bladder 12.

For safety, the bladder may be provided with the pressure relief valve 68 that relieves some internal pressure to avoid over inflation of the bladder 12.

Variations of the invention may include a band connected around the piercable end 42 of cartridge 40, with the band being fixed to the members 46 and 50. This would maintain centering between the piercing end 54 of level 52 and the piercable end 42 of cartridge 40 in case clip 56 was insufficient to do so.

Alternate embodiments of the invention may include chemical or other self-contained inboard gas generating means attached to, or in the bladder 12, for inflating the bladder 12 to its inflated condition for filling the storage volume of the soft-walled luggage.

Figure 6:
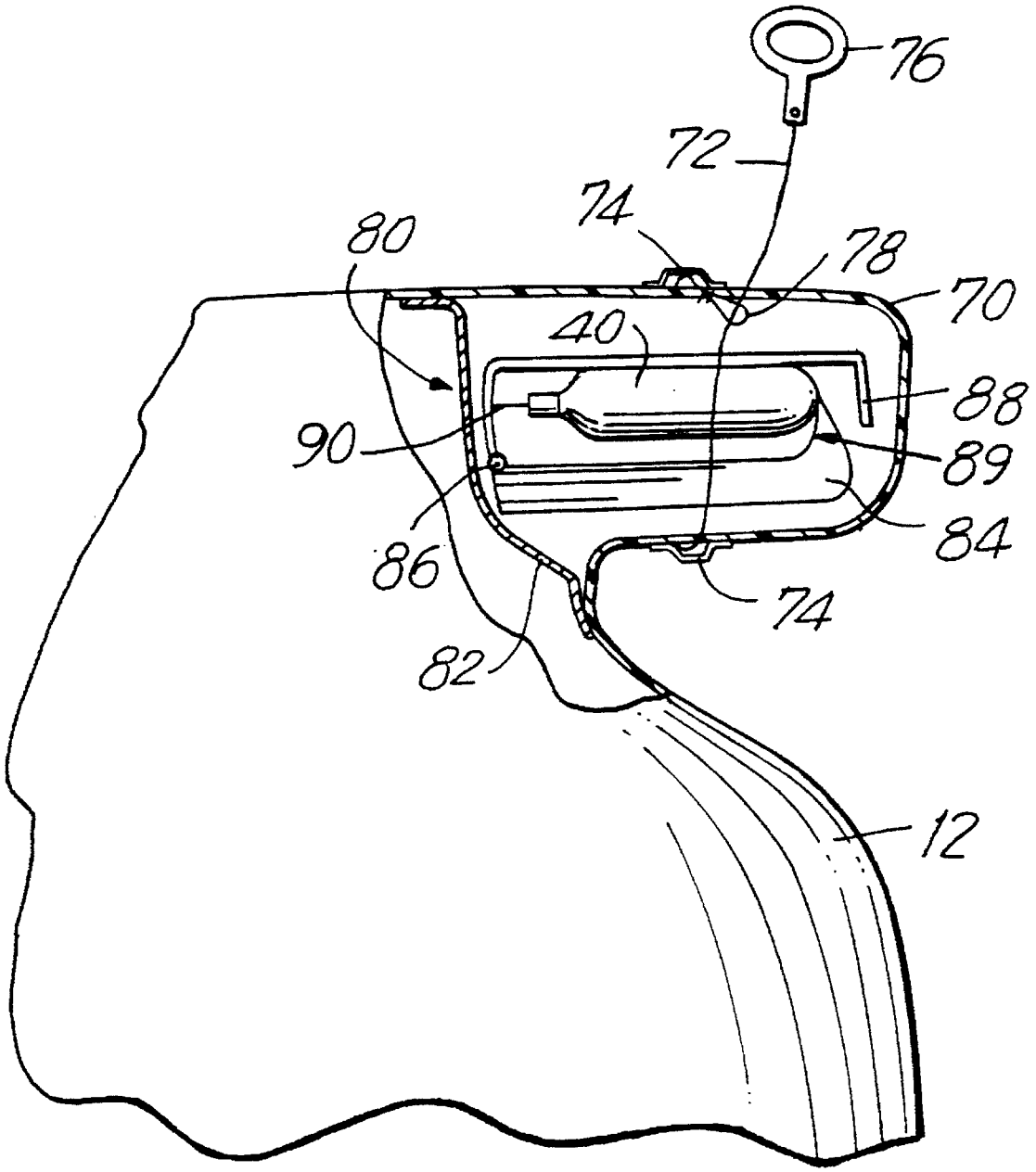
FIG. 6 is a partial sectional view illustrating a second embodiment of the invention with a simplified internal gas supply mechanism according to the present invention.

Referring to FIG. 6, a second embodiment of the invention comprises a bladder 12 having a projection 70 which is embraced by a loop of string, band or other flexible material 72 captured around the projection by a plurality of tabs 74 fastened to the outer surface of projection 70. A pull ring 76 is connected to one end of string 72 and a loop 78 is provided at the other end. The length of string connected to the ring 76 passes through loop 79 to produce a slip-noose effect which, when ring 76 is pulled smartly, squeezes and collapses projection 70.

A gas supply mechanism generally designated 80 is positioned in projection 70 and held by an internal strap or any other appropriate structure 82, to ensure that mechanism 80 remains in the projection 70.

Mechanism 80 comprises a lower wedge member 84 having a wedge shaped end with an inclined surface 86 at one end. The opposite end of wedge member 84 is connected at hinge 86 to a U-shaped retaining member 88. A $CO_2$ cartridge 40 is captured between members 84 and 88, with the rounded bottom end of the cartridge resting against the inclined surface 86.

A hollow piercing needle 90 is connected to the member 88 and positioned over a piercable end of cartridge 40. If members 88 and 84 are squeezed together, the inclined surface 86 pushes cartridge 40 against needle 90, puncturing the cartridge and releasing $CO_2$ gas into the interior of bladder 12.

This is done from outside the luggage, for example, through an almost closed zipper opening, through which the end of string 72 extends. In this way, expansion of the bladder 12 is limited by the walls of the luggage which is almost completely closed.

Figure 7:
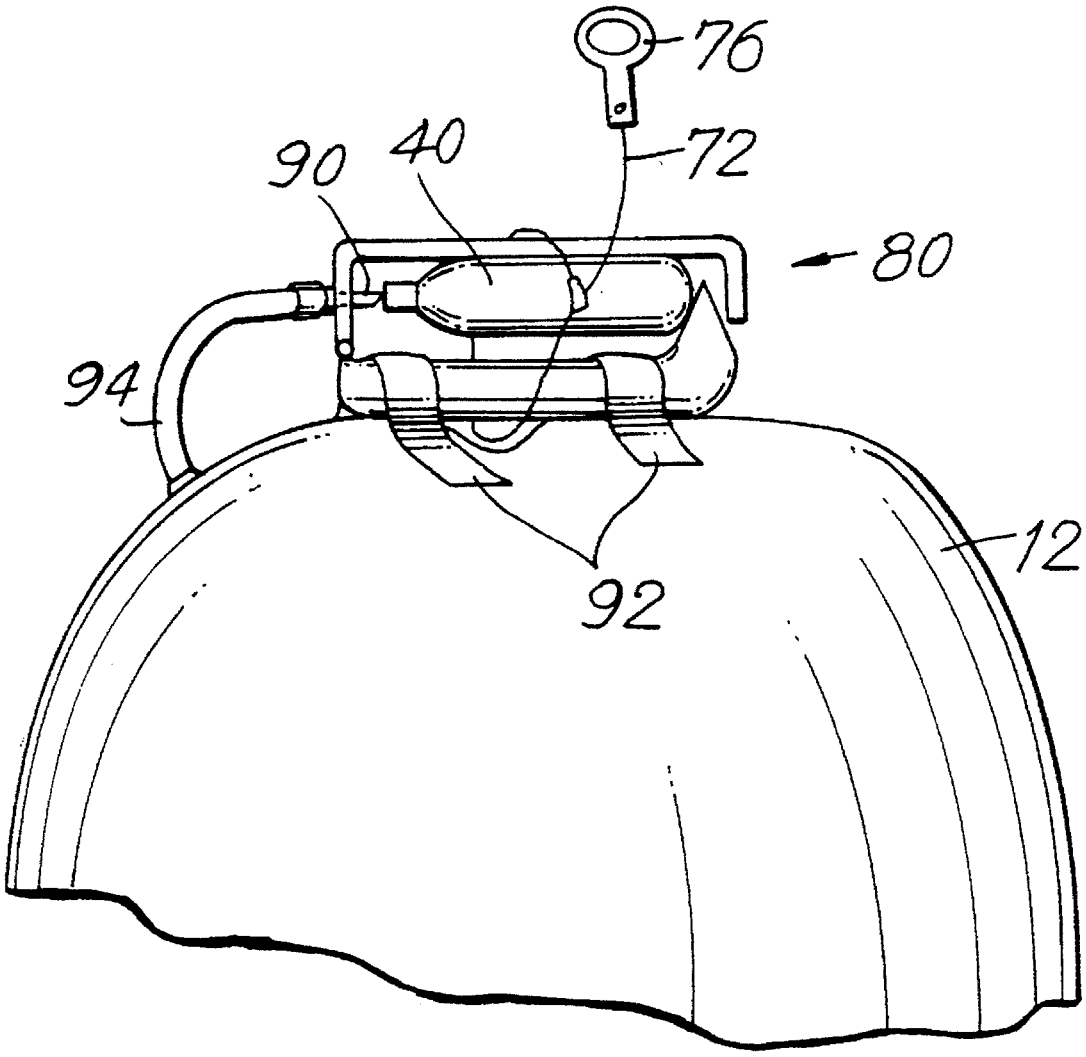
FIG. 7 is a partial elevational view of a third embodiment of the invention having a simplified external gas supply mechanism.

A third embodiment of the invention is illustrated in FIG. 7 where the same gas supply mechanism 80 is held by tabs 92 to the outer surface of bladder 12. A hole 94 is connected to an outer end of hollow piercing needle 90. The opposite end of hose 94 is connected to a fitting which communicates with the interior of bladder 12.

Ring 76 attached to string 72 is looped around mechanism 80 and, when ring 76 is pulled smartly, will cause a puncturing of $CO_2$ cartridge 40 and the supply of compressed $CO_2$ gas through hose 94 into bladder 12.

As with the embodiment of FIG. 6, the bladder and mechanism are entirely contained within the luggage which is closed except for a very small opening for the passage of string 72.

While a specific embodiment of the invention has been shown and described in detail to illustrate the application of the principles of the invention, it will be understood that the invention may be embodied otherwise without departing from such principles.

What is claimed is:

1. A luggage stuffer for filling soft-walled luggage having a storage volume therein for display in combination with a piece of luggage, comprising:

a piece of soft sided luggage;

an air-tight bladder in a deflated collapsed condition positioned in soft-walled luggage which is also collapsed for storage and transport, said bladder having an inflated condition substantially corresponding to the storage volume of the luggage for filling the luggage for display of the luggage at a point of sale for the luggage;

self-contained gas supply means in said luggage directly connected to the bladder for inflating the bladder from the deflated condition to the inflated condition;

pull means operatively connected to the gas supply means for activating the gas supply means to inflate the bladder to its inflated condition, when pulled from a position outside the luggage; and said luggage being closed except for a small opening through which the pull means is positioned in such a manner as to allow the pull means to be operated external of the luggage without further opening of the luggage.

2. A luggage stuffer according to claim 1, wherein said gas supply means comprises a pair of members movably mounted to each other, a $CO_2$ cartridge positioned between said members, said cartridge having a rounded end and a piercable opposite end, a hollow needle connected to one of said members and adjacent said piercable end for piercing said piercable end, a means defining an inclined surface on one of said members engaged with the rounded end of said cartridge for urging said cartridge into engagement with said needle when said members are moved toward each other.

3. A luggage stuffer according to claim 2, wherein said pull means comprises a loop of elongated material looped around said pair of members and pullable for squeezing said pair of members toward each other to urge said cartridge toward said needle to pierce said piercable end.

4. A luggage stuffer for filling soft-walled luggage having a storage volume therein for display, comprising:

an air-tight bladder having a deflated condition which is collapsed for positioning in soft-walled luggage which is also collapsed for storage and transport, said bladder having an inflated condition substantially corresponding to the storage volume of the luggage for filling the luggage for display of the luggage at a point of sale for the luggage;

self-contained, gas supply means directly connected to the bladder for inflating the bladder from the deflated condition to the inflated condition;

said gas supply means comprises a pair of members movably mounted to each other, a $CO_2$ cartridge positioned between said members, said cartridge having a rounded end and a piercable opposite end, a hollow needle connected to one of said members and adjacent said piercable end for piercing said piercable end, a means defining an inclined surface on one of said members engaged with the rounded end of said cartridge for urging said cartridge into engagement with said needle when said members are moved toward each other;

pull means operatively connected to the gas supply means for activating the gas supply means to inflate the bladder to its inflated condition, when pulled from a position outside the luggage volume; and said pull means comprises a loop of elongated material looped around said pair of members and pullable for squeezing said pair of members toward each other to urge said cartridge toward said needle to pierce said piercable end.

5. A luggage stuffer according to claim 4, wherein said bladder includes a projection, said gas supply means be mounted within said projection and said loop extending on said projection.

6. A luggage stuffer according to claim 5, wherein said pull means includes a pull member connected to an end of said loop and pullable from a position outside the luggage for closing the loop around the pair of members.

7. A luggage stuffer according to claim 4, including means for mounting said pair of members on an outer surface of said bladder and a conduit connecting said hollow needle to an interior of said bladder for supplying compressed gas to said bladder when said pair of members are moved toward each other.

8. A luggage stuffer according to claim 1, wherein said self-contained, gas supply means comprises a cradle and a $CO_2$ cartridge engaged in said cradle in said bladder, said pull means comprising a piercing member for piercing a piercable end of the $CO_2$ cartridge, and means to move said piercing member from outside the bladder to pierce the piercable end.

9. A method for stuffing soft-walled luggage for display, the soft-walled luggage having a storage volume therein, the method comprising:

providing an air-tight bladder in a deflated condition in the luggage when the storage volume is collapsed for transport and storage of the luggage;

providing a self-contained, gas supply mechanism with the bladder, which is activatable for inflating the bladder to an inflated position corresponding to the storage volume for filling the storage volume to expand the luggage for display;

providing an actuating means for activating said gas supply having a pull means to cause such release of gas;

positioning a portion of said pull means external of said luggage;

closing said luggage; and activating the gas supply mechanism for inflating the bladder to the inflated position to fill the storage volume, from outside the luggage volume by use of the pull means.

10. A method according to claim 9, including providing a $CO_2$ cartridge as the gas supply mechanism and piercing the $CO_2$ cartridge to inflate the bladder.

11. A method according to claim 9, including providing the gas supply mechanism in the bladder.

12. A method according to claim 9 including providing the gas supply mechanism on an outer surface of the bladder and establishing a communication between the gas supply mechanism and the interior of the bladder.

13. A method for stuffing soft-walled luggage for display, the soft-walled luggage having a storage volume therein, the method comprising:

providing an air-tight bladder having a projection in a deflated condition in the luggage when the storage volume is collapsed for transport and storage of the luggage;

providing a self-contained, gas supply mechanism within the projection in the bladder, which is activatable for inflating the bladder to an inflated position corresponding to the storage volume for filling the storage volume to expand the luggage for display; and activating the gas supply mechanism for inflating the bladder to the inflated position to fill the storage volume, from outside the luggage volume by constricting the projection with a loop of elongated material which is accessible from outside the luggage volume, for activating the gas supply mechanism.

* * * * *